US006548968B2

(12) United States Patent
Song et al.

(10) Patent No.: US 6,548,968 B2
(45) Date of Patent: Apr. 15, 2003

(54) ELECTRODE ASSEMBLY AND DYNAMIC FOCUS ELECTRON GUN UTILIZING THE SAME

(75) Inventors: Yong-Seok Song, Ulsan (KR); Sung-Jun An, Suwon (KR); Do-Hyoung Kim, Ulsan Metropolitan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/989,433

(22) Filed: Nov. 21, 2001

(65) Prior Publication Data

US 2002/0060533 A1 May 23, 2002

(30) Foreign Application Priority Data

Nov. 23, 2000 (KR) ..... 2000-70005

(51) Int. Cl.[7] ..... G09G 1/04

(52) U.S. Cl. ..... 315/382; 315/382.1; 315/368.21; 315/395

(58) Field of Search ..... 315/14–16, 368.15, 315/368.16, 368.18, 368.21, 371, 382, 382.1, 395

(56) References Cited

U.S. PATENT DOCUMENTS

| | | | | |
|---|---|---|---|---|
| 4,814,670 A | | 3/1989 | Suzuki et al. | 315/15 |
| 5,027,043 A | | 6/1991 | Chen et al. | 315/368 |
| 5,182,492 A | * | 1/1993 | Chen | 315/14 |
| 5,399,946 A | * | 3/1995 | Son et al. | 315/382 |
| 6,172,450 B1 | * | 1/2001 | Natori et al. | 313/414 |
| 6,396,221 B1 | * | 5/2002 | Uchida et al. | 315/382 |
| 6,404,147 B1 | * | 6/2002 | Shigematsu et al. | 315/368.21 |

* cited by examiner

*Primary Examiner*—Haissa Philogene
(74) *Attorney, Agent, or Firm*—Robert E. Bushnell, Esq.

(57) ABSTRACT

An electrode assembly includes at least first and second electrodes for forming one or more dynamic quadrupole lenses to emit electron beams and an electron gun using the same. A first parabolic waveform signal having voltages decreasing from the center to the periphery of a screen on which the electron beams land is applied to the first electrode, and a second parabolic waveform signal having voltages increasing from the center to the periphery of the screen is applied to the second electrode, in synchronization with horizontal and vertical deflection signals for horizontally and vertically deflecting electron beams emitted from the electrode assembly.

8 Claims, 6 Drawing Sheets

ELECTRODE ASSEMBLY AND DYNAMIC FOCUS ELECTRON GUN UTILIZING THE SAME

CLAIM OF PRIORITY

This application makes reference to, incorporates the same herein, and claims all benefits accruing under 35 U.S.C. §119 from an application for ELECTRODE ASSEMBLY AND DYNAMIC FOCUS ELECTRON GUN UTILIZING THE SAME earlier filed in the Korean Industrial Property Office on Nov. 23, 2000, and there duly assigned Serial No. 2000-70005 by that Office.

BACKGROUND OF THE INVENTION

1. Field of the Invention

The present invention relates to an electrode assembly and a dynamic focus electron gun utilizing the same, and more particularly, to an electrode assembly having first and second electrodes for forming at least one dynamic focus quadrupole lens to emit electron beams, and an electron gun utilizing the electrode assembly.

2. Description of the Related Art

The performance of a cathode ray tube (CRT) is dependent upon the state in which emitted electron beams land on a screen. Thus, in order to achieve accurate landing of the emitted electron beams on a fluorescent point of a phosphor screen, various techniques to improve focusing characteristics and reduce astigmatism of electronic lenses have been proposed.

In particular, in order to prevent electron beams landing on a phosphor screen from being elongated in an elliptic shape due to a difference in barrel and pincushion magnetic fields occurring when electron beams emitted from an electron gun are deflected by a deflection yoke, a dynamic focus electron gun by which the electron beams emitted therefrom are made relatively elliptical in synchronization with horizontal and vertical deflection periods, is used.

A quadrupole lens is described in detail in U.S. Pat. No. 4,814,670 to Suzuki et al. for Cathode Ray Tube Apparatus Having Focusing Grids with Horizontally and Vertically Oblong Through Holes and U.S. Pat. No. 5,027,043 to Chen et al. for Electron Gun System with Dynamic Convergence Control. The first and second dynamic quadrupole lenses make electron beams emitted from an electron gun be relatively elliptical in synchronization with horizontal and vertical deflection periods. Accordingly, the electron beams landing on a screen of a CRT become circular throughout the entire area of the screen.

According to the conventional dynamic focus electron gun, the magnifications of dynamic quadrupole lenses are set only by a voltage difference between a static focus voltage and a parabolic waveform signal. Thus, in order to increase an average magnification of dynamic quadrupole lenses, the average voltage of the parabolic waveform signal must be relatively high. This problem is more serious for larger CRTs. In other words, the performance, reliability and lifetime of a dynamic focus electron gun may deteriorate by application of high driving voltages.

SUMMARY OF THE INVENTION

It is therefore an object of the present invention to provide an electrode assembly which can improve the performance, reliability and lifetime of an electron gun by performing a desired dynamic focusing action even by application of relatively low voltages, and a dynamic focus electron gun utilizing the electrode assembly.

It is another object to provide an electrode assembly that is easy to manufacture.

It is still another object to provide an electrode assembly that is inexpensive to manufacture.

To achieve the above and other objects of the present invention, there is provided an electrode assembly including at least first and second electrodes for forming one or more dynamic quadrupole lenses to emit electron beams, and a dynamic focus electron gun using the same. A first parabolic waveform signal having voltages decreasing from the center to the periphery of a screen on which the electron beams land is applied to the first electrode, and a second parabolic waveform signal having voltages increasing from the center to the periphery of the screen is applied to the second electrode, in synchronization with horizontal and vertical deflection signals for horizontally and vertically deflecting electron beams emitted from the electrode assembly.

According to the electrode assembly of the present invention and the electron gun utilizing the same, a voltage applied between the first and second electrodes becomes relatively high by the interrelationship between the first and second parabolic waveform signals. Accordingly, even if the average of the first and second parabolic waveform signals is decreased, a desired dynamic focusing function can be performed, thereby improving the performance, reliability and lifetime of the electron gun.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
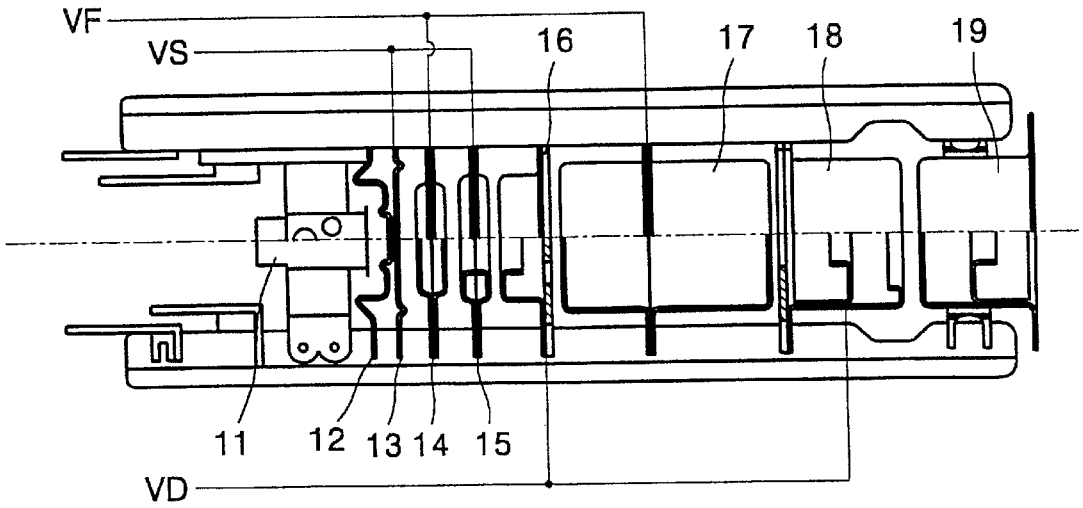
FIG. 1 is a sectional view illustrating the internal structure of a conventional dynamic focus electron gun.

Turning now to the drawings, referring to FIG. 1, an earlier dynamic focus electron gun includes a cathode 11, a control electrode 12, a screen electrode 13, first through fifth focus electrodes 14–18 and a final accelerating electrode 19. A data signal is applied to the cathode 11 and horizontal and vertical blanking signals are applied to the control electrode 12. A screen voltage VS of positive polarity is applied to the screen electrode 13 and the second focus electrode 15 and a static focus voltage VF of positive polarity is applied to the first and fourth focus electrodes 14 and 17. Here, the static focus voltage VF is set to be higher than the screen voltage VS for the purpose of achieving acceleration and focusing. A parabolic waveform signal VD having voltages varying in a periodic manner in synchronization with vertical and horizontal deflection signals is applied to the third and fifth focus electrodes 16 and 18. Generally, a difference between the highest voltage and the lowest voltage of the parabolic waveform signal VD is approximately 2.8 KV. The positive-polarity voltage applied to the final accelerating electrode 19 is the highest static voltage.

A static prefocus lens is formed between the screen electrode 13 and the first focus electrode 14. A static auxiliary lens is formed between the first and second focus electrodes 14 and 15. A dynamic auxiliary lens is formed between the second and third electrodes 15 and 16. A dynamic quadrupole lens is formed between the third and fourth focus electrodes 16 and 17. Here, a quadrupole lens is an electronic lens having different functions horizontally and vertically according to shapes of opposing electron beam apertures. A second dynamic quadrupole lens is formed between the fourth and fifth focus electrodes 17 and 18. Dynamic main lenses having relative lower magnifications are formed between the fifth focus electrode 18 and the final accelerating electrode 19. The first and second dynamic quadrupole lenses make electron beams emitted from an electron gun be relatively elliptical in synchronization with horizontal and vertical deflection periods. Accordingly, the electron beams landing on a screen of a CRT become circular throughout the entire area of the screen.

According to the earlier dynamic focus electron gun, the magnifications of dynamic quadrupole lenses are set only by a voltage difference between a static focus voltage VF and a parabolic waveform signal VD. Thus, in order to increase an average magnification of dynamic quadrupole lenses, the average voltage of the parabolic waveform signal VD must be relatively high. This problem is more serious for larger CRTs. In other words, the performance, reliability and lifetime of a dynamic focus electron gun may deteriorate by application of high driving voltages.

Figure 2:
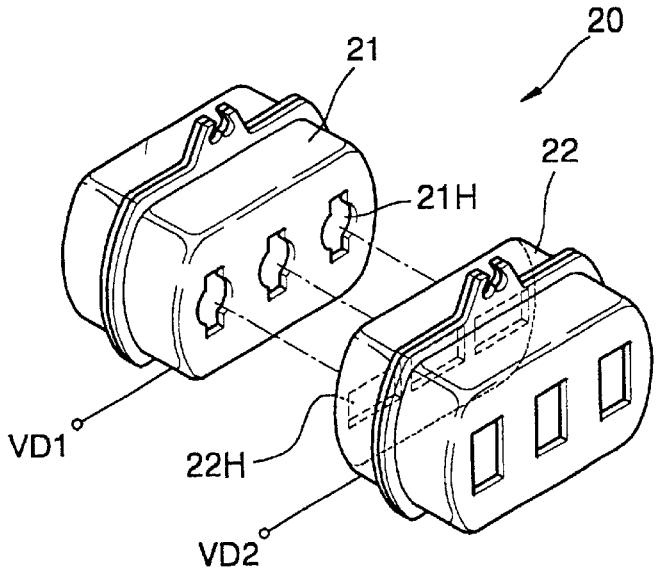
FIG. 2 is a perspective view of an electrode assembly according to an embodiment of the present invention.
Figure 3:
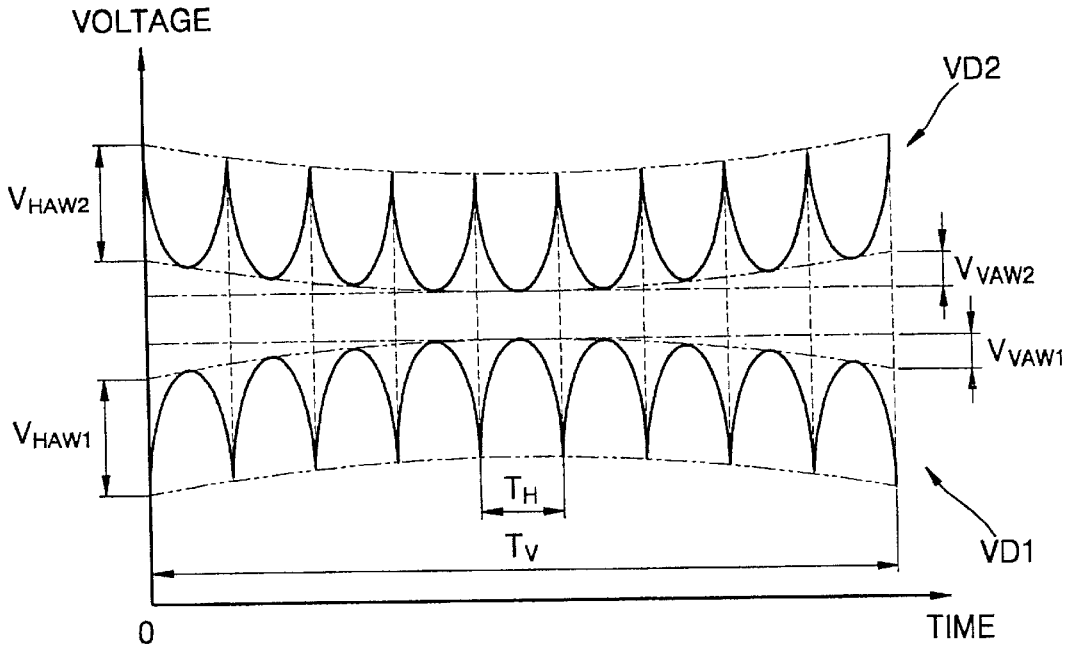
FIG. 3 is a waveform diagram illustrating parabolic waveform signals applied to the electrode assembly shown in FIG. 2.

Referring to FIGS. 2 and 3, an electrode assembly according to the present invention includes at least first and second electrodes 21 and 22 for forming at least one dynamic quadrupole lens to emit electron beams. In FIG. 3, for convenience sake of explanation, only nine horizontal scanning lines are provided on a phosphor layer on which electron beams land. Vertically elongated apertures 21H are formed on a first electrode 21. Horizontally elongated apertures 22H are formed on a second electrode 22. In such a manner, since the shapes of the apertures 21H and 22H of the first and second electrodes 21 and 22 opposing each other are different, a quadruple lens having different lens functions horizontally and vertically can be formed. As occasion demands, the electron beam apertures 21H and 22H may be formed in various shapes, e.g., rectangles, ellipses and keyholes.

Here, in synchronization with horizontal and vertical deflection signals for horizontally and vertically deflecting electron beams emitted from an electron gun, a first parabolic waveform signal VD1 having voltages decreasing from the center of a screen on which the electron beams land is applied to the first electrode 21, and a second parabolic waveform signal VD2 having voltages increasing from the center to the periphery of the screen is applied to th& second electrode 22. This will now be described in more detail.

The voltages of the first parabolic waveform signal VD1 applied to the first electrode 21 decrease from the horizontal center to the periphery of the screen for every horizontal deflection period $T_H$ and decrease from the vertical center of the screen for every vertical deflection period $T_V$. On the contrary, the voltages of the second parabolic waveform signal VD2 applied to the second electrode 22 increase from the horizontal center to the periphery of the screen for every horizontal deflection period $T_H$ and increase from the vertical center of the screen for every vertical deflection period $T_V$. Accordingly, a quadrupole lens having a large divergent power vertically and a large focusing power horizontally is formed between the first and second electrodes 21 and 22. The magnification of the quadrupole lens increases from the horizontal center to the periphery of the screen and slightly increases from the vertical center to the periphery of the screen.

In the electrode assembly according to the present invention, the voltages applied between the first ad second electrodes 21 and 22 relatively increase by the interrelationship between the first and second parabolic waveform signals VD1 and VD2. Thus, even if the average voltages of the first and second parabolic waveform signals VD1 and VD2 are relatively decreased, a desired dynamic focusing function can be performed, which will now be described in more detail.

For the horizontal deflection period $T_H$, the variation of voltages applied between the first and second electrodes 21 and 22 equals the sum $V_{HAW}1+V_{HAW}2$ (e.g., 2.8 KV) of the variation $V_{HAW}1$ (e.g., 1.4 KV) of the voltage applied to the first electrode 21 and the variation $V_{HAW}2$ (e.g., 1.4 KV) of the voltage applied to the second electrode 22. In contrast with the conventional dynamic electrode assembly in which the voltage variation $V_{HAW}1+V_{HAW}2$ is applied to only the second electrode, that is, the third focus electrode 16 or the fifth focus electrode 18 shown in FIG. 1, the electrode assembly according to the present invention can reduce the voltage applied to the second electrode 22 during the horizontal deflection period $T_H$, by the amount of variation $V_{HAW}1$ (e.g., 1.4 KV) of the voltage applied to the first electrode 21.

For the vertical deflection period $T_V$, the variation of voltages applied between the first and second electrodes 21 and 22 equals the sum $V_{VAW}1+V_{VAW}2$ (e.g., 300 KV) of the variation $V_{VAW}1$ (e.g., 150 V) of the voltage applied to the first electrode 21 and the variation $V_{VAW}2$ (e.g., 150 V) of the voltage applied to the second electrode 22. In contrast with the conventional dynamic electrode assembly in which the voltage variation $V_{VAW}1+V_{VAW}2$ is applied to only the second electrode, the electrode assembly according to the present invention can reduce the voltage applied to the second electrode 22 during the vertical deflection period $T_V$, by the amount of variation $V_{VAW}1$ (e.g., 150 V) of the voltage applied to the first electrode 21.

Figure 4:
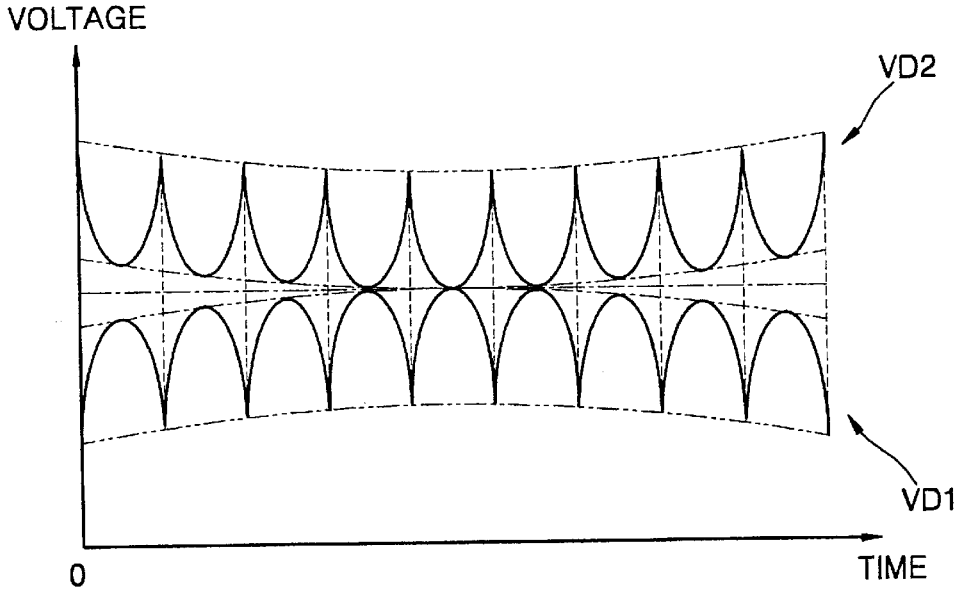
FIGS. 4 through 6 illustrate examples of the signals shown in FIG. 3.
Figure 5:
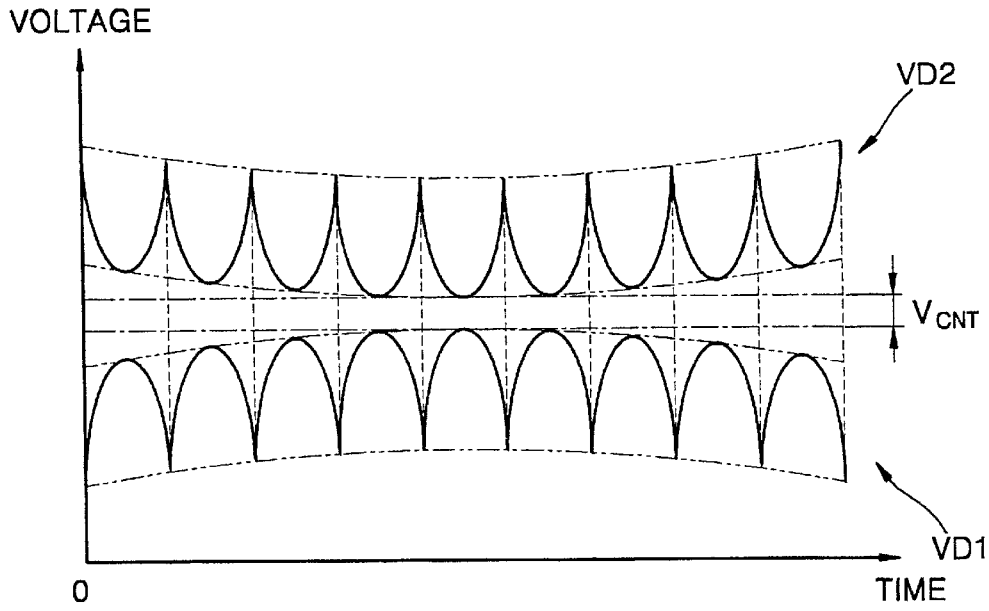
Figure 6:
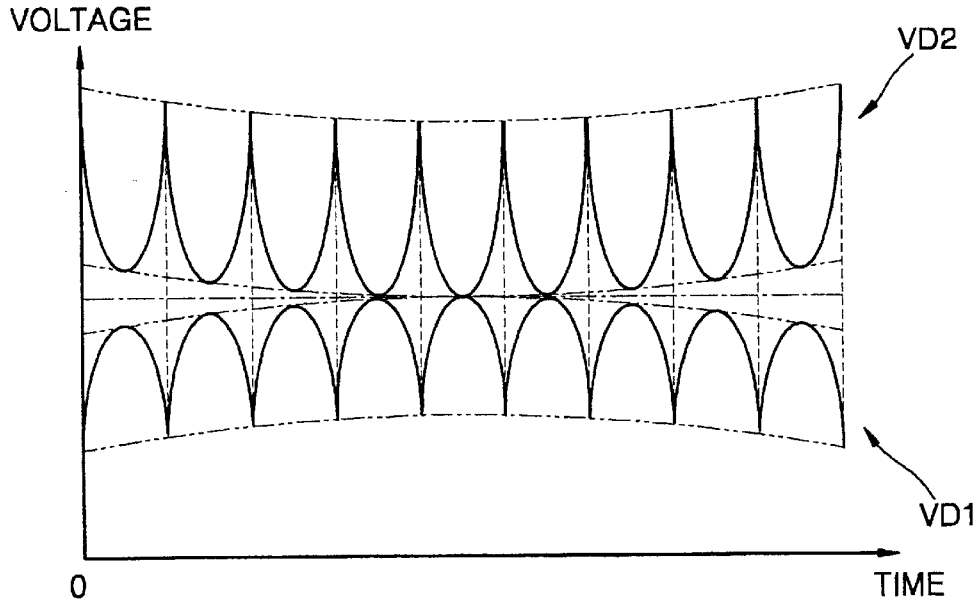

FIGS. 4 through 6 show examples of first and second parabolic waveform signals VD1 and VD2 shown in FIG. 3.

Referring to FIG. 4, the maximum voltage of the first parabolic waveform signal VD1 is equal to the minimum voltage of the second parabolic waveform signal VD2. In this case, the average magnification of the dynamic quadrupole lens thus made is relatively low and the section of an electron beam emitted to the center of a screen in the horizontal and vertical directions is circular. Referring to FIG. 5, the maximum voltage of the first parabolic waveform signal VD1 goes below the minimum voltage of the second parabolic waveform signal VD2. The difference between the maximum voltage of the first parabolic waveform signal VD1 and the minimum voltage of the second parabolic waveform signal VD2 is $V_{CNT}$. In this case, the average magnification of the dynamic quadrupole lens thus made is relatively high and the section of an electron beam emitted to the center of a screen in the horizontal and vertical directions is slightly elongated in a horizontal direction, that is, substantially circular. Referring to FIG. 6, the slope of the first parabolic waveform is smaller than that of the second parabolic waveform. In this case, the average voltage applied to the second electrode 22 is relatively high. However, the lens magnification between one of exit-side electrodes, e.g., a final accelerating electrode of a dynamic focus electron gun, and the second electrode 22, can be reduced.

Figure 7:
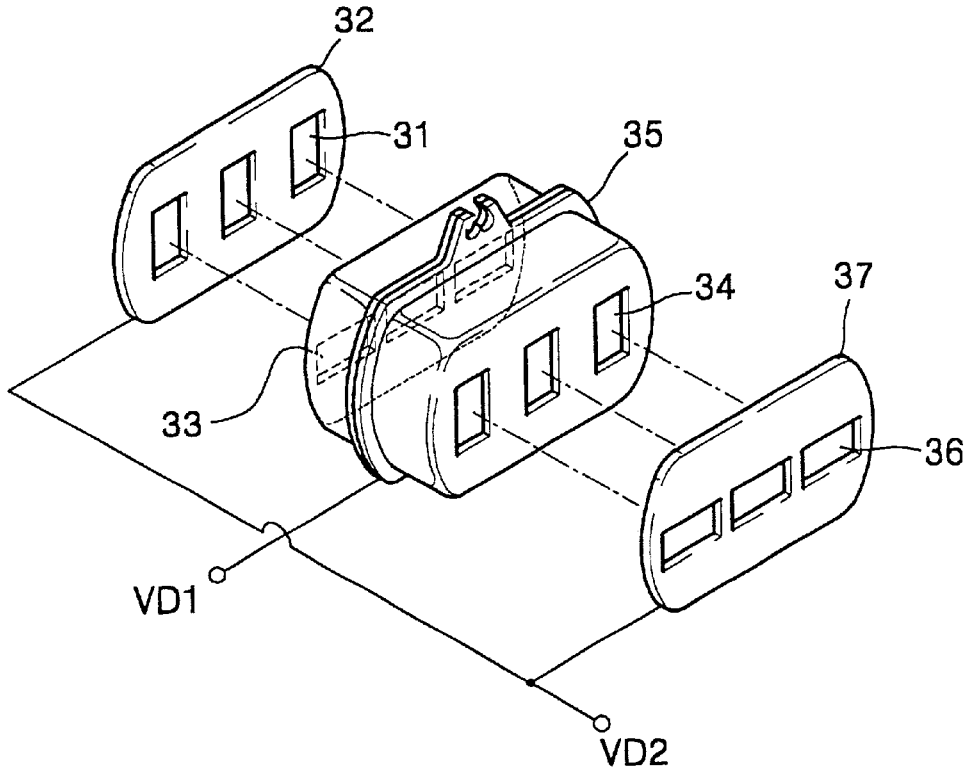
FIG. 7 is a perspective view of an electrode assembly according to another embodiment of the present invention.

Referring to FIG. 7, an electrode assembly according to another embodiment of the present invention includes at least first, second and third electrodes 32, 35 and 37, for forming at least two dynamic quadrupole lenses, sequentially arranged, and emitting electron beams. Vertically elongated electron beam apertures 31 are formed at the first electrode 32, horizontally elongated electron beam apertures 33 are formed at the entrance side of the second electrode 35, and vertically elongated electron beam apertures 34 are formed at the exit side of the second electrode 35. Horizontally elongated electron beam apertures 36 are formed at the third electrode 37. As described above, since the shapes of the electron beam apertures 31, 33, 34 and 36 formed at the opposing electrodes 32, 35 and 37 are different from one another, quadrupole lenses having different lens functions horizontally and vertically can be made. As occasion demands, the beam apertures 31, 33, 34 and 36 may vary in various shapes such as rectangles, ellipses or keyholes.

Here, in synchronization with horizontal and vertical deflection signals for deflecting emitted electron beams horizontally and vertically across the screen, the first parabolic waveform signal (VD1 of FIGS. 3 through 6) whose voltage decreases from the center to the periphery of the screen where the emitted electron beams land is applied to the second electrode 35 and the second parabolic waveform signal (VD2 of FIGS. 3 through 6) whose voltage increases from the center to the periphery of the screen is applied to the first and third electrodes 32 and 37. This will now be described in more detail.

In the first parabolic waveform signal VD1 applied to the second electrode 35, the voltage decreases from the horizontal centerline to the periphery of the screen for each horizontal deflection period ($T_H$ of FIG. 3) and decreases from the vertical centerline to the periphery of the screen for each vertical deflection period ($T_V$ of FIG. 3). Conversely, in the second parabolic waveform signal VD2 applied to the first and third electrodes 32 and 37, the voltage increases from the horizontal centerline to the periphery of the screen for each horizontal deflection period $T_H$ and increases from the vertical centerline to the periphery of the screen for each vertical deflection period $T_V$. Accordingly, a first dynamic quadrupole lens in which vertical convergence is relatively strong and horizontal divergence is relatively strong, is formed between the first and second electrodes 32 and 35. Also, a second dynamic quadrupole lens in which vertical divergence is relatively strong and horizontal convergence is relatively strong, is formed between the second and third electrodes 35 and 37. The magnification of the first or second quadrupole lens increases from the horizontal central part of the screen to the periphery and slightly increases from the vertical central part to the periphery.

According to the electrode assembly of the present invention, the voltages applied between the first and second electrodes 32 and 35 and between the second and third electrodes 35 and 37 become relatively higher by the interrelationship between the first and second parabolic waveform signals VD1 and VD2. Accordingly, even if the average voltages of the first and second parabolic waveform signals VD1 and VD2 are relatively reduced, a desired dynamic focusing action can be achieved, as described in FIGS. 2 through 6.

Figure 8:
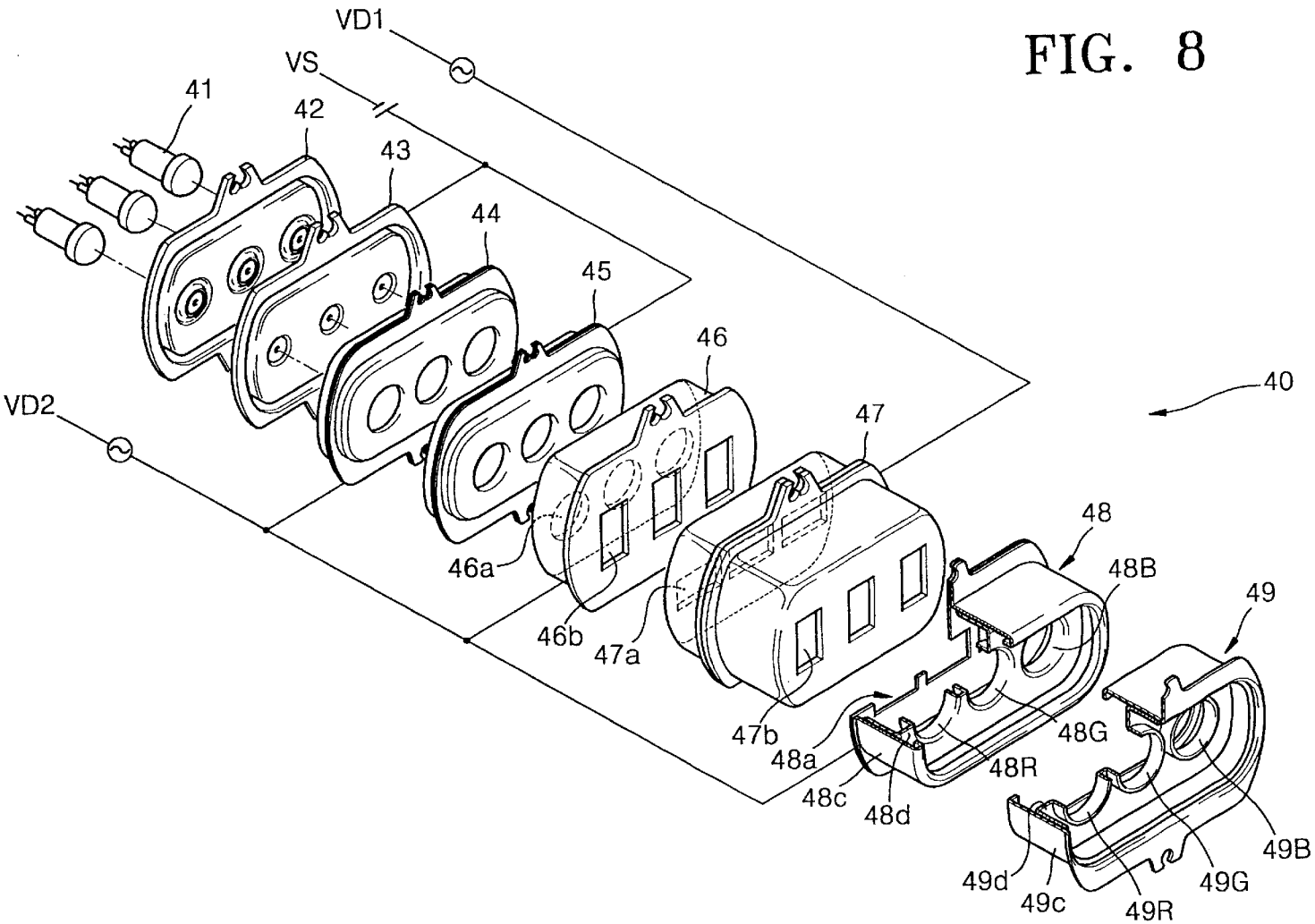
FIG. 8 is a perspective view of a dynamic focus electron gun according to an embodiment of the present invention.
Figure 9:
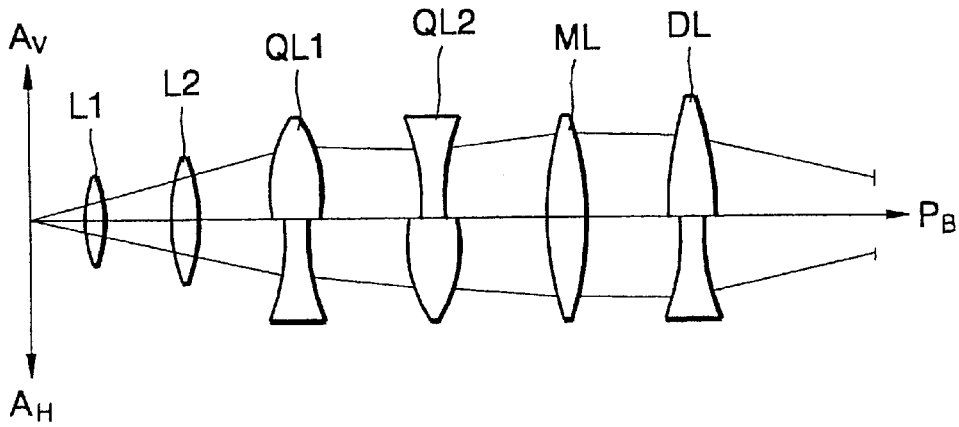
FIG. 9 illustrates lenses formed by the electron gun shown in FIG. 8.

FIG. 8 shows a dynamic focus electron gun according to an embodiment of the present invention and FIG. 9 shows lenses formed by the electron gun shown in FIG. 8. In FIG. 9, reference mark $A_V$ denotes a vertical area, reference mark $A_H$ denotes a horizontal area and reference mark $P_B$ denotes a direction of movement of electron beams.

Referring to FIGS. 8 and 9, the dynamic focus electron gun according to the present invention includes third, fourth and fifth focus electrodes 46, 47 and 48 for forming two dynamic quadrupole lenses QL1 and QL2, sequentially disposed, and emits electron beams. Circular electron beam apertures 46*a* are formed at the entrance side of the third focus electrode 46 and vertically elongated electron beams 46*b* are formed at the exit side of the third focus electrode 46. Horizontally elongated beam apertures 47*a* are formed at the entrance side of the fourth focus electrode 47 and vertically elongated beam apertures 47*b* are formed at the exit side of the fourth focus electrode 47. Also, horizontally elongated beam apertures 48*a* are formed at the entrance side of the fifth focus electrode 48. As described above, since opposing beam apertures of the third, fourth and fifth focusing electrodes 46, 47 and 48 have different shapes, quadrupole electronic lenses having different lens actions horizontally and vertically are formed. The fifth focus electrode 48 includes an outer electrode 48*c* and an internal electrode 48*d*. Circular beam apertures 48R, 48G and 48B are formed at the internal electrode 48*d*, and circular electron beams are formed at the respective electrodes although not separately noted. The final accelerating electrode 49 includes an outer electrode 49*c* and an internal electrode 49*d*. Circular beam apertures 49R, 49G and 49B are formed at the internal electrode 49*d*, and circular electron beams are formed at the respective electrodes although not separately noted.

Here, in synchronization with horizontal and vertical deflection signals for deflecting emitted electron beams horizontally and vertically across the screen, the first parabolic waveform signal (VD1 of FIGS. 3 through 6) whose voltage decreases from the center to the periphery of the screen where the emitted electron beams land is applied to the fourth focus electrode 47 and the second parabolic waveform signal (VD2 of FIGS. 3 through 6) whose voltage increases from the center to the periphery of the screen is applied to the third and fourth electrodes 46 and 47. This will now be described in more detail.

In the first parabolic waveform signal VD1 applied to the fourth electrode 47, the voltage decreases from the horizontal centerline to the periphery of the screen for each horizontal deflection period ($T_H$ of FIG. 3) and decreases from the vertical centerline to the periphery of the screen for each vertical deflection period ($T_V$ of FIG. 3). Conversely, in the second parabolic waveform signal VD2 applied to the third and fifth electrodes 46 and 48, the voltage increases from the horizontal centerline to the periphery of the screen for each horizontal deflection period $T_H$ and increases from the vertical centerline to the periphery of the screen for each vertical deflection period $T_V$. Accordingly, a first dynamic quadrupole lens QL1 in which vertical convergence is relatively strong and horizontal divergence is relatively strong, is formed between the third and fourth electrodes 46 and 47. Also, a second dynamic quadrupole lens QL2 in which vertical divergence is relatively strong and horizontal convergence is relatively strong, is formed between the fourth and fifth electrodes 47 and 48. The magnification of the first or second quadrupole lens QL1 or QL2 increases from the horizontal central part of the screen to the periphery and slightly increases from the vertical central part to the periphery.

According to the electrode assembly of the present invention, the voltages applied between the third and fourth electrodes 46 and 47 and between the fourth and fifth electrodes 47 and 48 become relatively higher by the interrelationship between the first and second parabolic waveform signals VD1 and VD2. Accordingly, even if the average voltages of the first and second parabolic waveform signals VD1 and VD2 are relatively reduced, a desired dynamic focusing action can be achieved, as described in FIGS. 2 through 6.

Data signals are applied to cathodes 41 and horizontal/vertical blanking signals are applied to a control electrode 42. A screen voltage VS of positive polarity is applied to a screen electrode 43 and the second focus electrode 45. The second parabolic waveform signal VD2 is applied to the first focus electrode 44 and an anode voltage of the highest positive polarity is applied to a final accelerating electrode 49.

The respective cathodes 41 generate electron beams according to the data signals applied thereto. Emission or non-emission of the generated electron beams is determined by the horizontal/vertical blanking signals applied to the control electrode 42. The electron beams emitted through the apertures of the control electrode 42 are accelerated by the positive-polarity screen voltage VS applied to the screen electrode 43. A dynamic prefocus lens L1 performing horizontal and vertical focusing actions is formed between the screen electrode 43 and the first focus electrode 44. Dynamic auxiliary lenses L2 performing horizontal and vertical focusing actions are formed between each of the respective first through third focus electrodes 44, 45 and 46. The first dynamic quadrupole lens QL1 which vertically converges and horizontally diverges electron beams is formed between the third and fourth focus electrodes 46 and 47, and the second dynamic quadrupole lens QL2 which vertically diverges and horizontally converges electron beams is formed between the fourth and fifth focus electrodes 47 and 48. A dynamic main lens ML which vertically and horizontally converges electron beams is formed between the fifth focus electrode 48 and the final accelerating electrode 49. The electron beams emitted from the final accelerating electrode 49 land on the screen through a dynamic deflecting lens DL formed by the deflecting force in the CRT. Here, the sections of the electron beams emitted from the final accelerating electrode 49 are made relatively elliptical for the purpose of compensating for ellipticity during deflection.

As described above, in the electrode assembly according to the present invention and the electron gun using the same, voltages applied between the first and second electrodes become relatively high by the interrelationship between the first and second parabolic waveform signals. Accordingly, even if the average voltages of the first and second parabolic waveform signals are relatively reduced, a desired dynamic focusing action can be achieved, thereby improving the performance, reliability and lifetime characteristics of the electron gun.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electrode assembly, comprising first and second electrodes forming at least one dynamic quadrupole lens to emit electron beams, a first parabolic waveform signal having voltages decreasing from the center to the periphery of a screen on which the electron beams land being applied to the first electrode, and a second parabolic waveform signal having voltages increasing from the center to the periphery of the screen being applied to the second electrode, in synchronization with horizontal and vertical deflection signals for horizontally and vertically deflecting electron beams emitted from the electrode assembly.

2. The electrode assembly of claim 1, further comprising of vertically elongated electron beam holes formed at the first electrode and horizontally elongated beam holes formed at the second electrode.

3. The electrode assembly of claim 1, further comprising of the shape of apertures for the electron beams formed on the first and second electrodes opposing each other being different.

4. The electrode assembly of claim 1, further comprised of the maximum voltage of the first parabolic waveform signal being equal to the minimum voltage of the second parabolic waveform signal.

5. The electrode assembly of claim 1, further comprised of the maximum voltage of the first parabolic waveform signal being below the minimum voltage of the second parabolic waveform signal.

6. The electrode assembly of claim 1, further comprised of the slope of the first parabolic waveform being smaller than the second parabolic waveform for each horizontal deflection period.

7. An electrode assembly, comprising first, second and third electrodes for forming at least one dynamic quadrupole lens to emit electron beams, a first parabolic waveform signal having voltages decreasing from the center to the periphery of a screen on which the electron beams land being applied to the second electrode, and a second parabolic waveform signal having voltages increasing from the center to the periphery of the screen being applied to the first and third electrode, in synchronization with horizontal and vertical deflection signals for horizontally and vertically deflecting electron beams emitted from the electrode assembly.

8. An electron gun having an electrode assembly, comprising first and second electrodes forming at least one dynamic quadrupole lens to emit electron beams, a first parabolic waveform signal having voltages decreasing from the center to the periphery of a screen on which the electron beams land being applied to the first electrode, and a second parabolic waveform signal having voltages increasing from the center to the periphery of the screen being applied to the second electrode, in synchronization with horizontal and vertical deflection signals for horizontally and vertically deflecting emitted electron beams.

* * * * *